US011440695B2

(12) United States Patent
Aihara et al.

(10) Patent No.: US 11,440,695 B2
(45) Date of Patent: Sep. 13, 2022

(54) METHOD FOR MANUFACTURING METAL BOTTLE, AND METAL BOTTLE

(71) Applicant: TOYO SEIKAN CO., LTD., Tokyo (JP)

(72) Inventors: Takeshi Aihara, Yokohama (JP); Masaomi Tamura, Tokyo (JP); Toshiyuki Hasegawa, Kawasaki (JP); Takeshi Murase, Kawasaki (JP); Tomohiko Nakamura, Yokohama (JP); Naoya Matsumoto, Kawasaki (JP); Nobuhiro Sasajima, Yokohama (JP)

(73) Assignee: TOYO SEIKAN CO., LTD., Tokyo (JP)

( * ) Notice: Subject to any disclaimer, the term of this patent is extended or adjusted under 35 U.S.C. 154(b) by 166 days.

(21) Appl. No.: 16/471,711

(22) PCT Filed: Oct. 10, 2017

(86) PCT No.: PCT/JP2017/036637
§ 371 (c)(1),
(2) Date: Jun. 20, 2019

(87) PCT Pub. No.: WO2018/116583
PCT Pub. Date: Jun. 28, 2018

(65) Prior Publication Data

US 2019/0329925 A1 Oct. 31, 2019

(30) Foreign Application Priority Data

Dec. 22, 2016 (JP) ..... JP2016-249240

(51) Int. Cl.
*B65D 1/02* (2006.01)
*B21D 51/38* (2006.01)
*B65D 41/04* (2006.01)

(52) U.S. Cl.
CPC ..... *B65D 1/0246* (2013.01); *B21D 51/38* (2013.01); *B65D 41/04* (2013.01)

(58) Field of Classification Search
CPC ... B65D 1/0246; B21D 51/38; B21D 51/2623
(Continued)

(56) References Cited

U.S. PATENT DOCUMENTS 4,699,285 A * 10/1987 Perne ..... B65D 41/3409 215/252
10,518,940 B2 12/2019 Vanon
2005/0067365 A1 3/2005 Hanafusa et al.

FOREIGN PATENT DOCUMENTS

JP 2003-011979 1/2003
JP 2004-35036 A 2/2004
(Continued)

OTHER PUBLICATIONS

Extended European Search Report in AP application No. 17882493.4 dated Jul. 1, 2020.
(Continued)

*Primary Examiner* — James N Smalley
*Assistant Examiner* — Jennifer Castriotta
(74) *Attorney, Agent, or Firm* — Greenblum & Bernstein, P.L.C.

(57) ABSTRACT

A method for manufacturing a metal bottle having a mouthpiece in an upper part of a bottomed cylindrical bottle body, including forming a screw part on the mouthpiece and then forming a curl at a tip of the mouthpiece. During formation of the screw part, a height of the first-stage screw thread from a tip side in a complete screw part and a height of the second-stage screw thread from the tip side are substantially equal and a distance between an apex part of the first-stage screw thread and a bottle axis is smaller than a distance between the apex part of the second-stage screw thread and
(Continued)

the bottle axis. After formation of the curl, a distance between the apex part of the first-stage screw thread and the bottle axis and a distance between the apex part of the second-stage screw thread and the bottle axis are substantially equal.

3 Claims, 4 Drawing Sheets

(58) Field of Classification Search
USPC ..... 215/44; 413/23
See application file for complete search history.

(56) References Cited

FOREIGN PATENT DOCUMENTS

| | | |
|---|---|---|
| JP | 2004-74168 | 3/2004 |
| JP | 2004-148403 | 5/2004 |
| JP | 2008-87071 | 4/2008 |
| WO | 2015/145074 A1 | 10/2015 |

OTHER PUBLICATIONS

Chinese Office Action dated Jan. 19, 2020 in Chinese application No. 201780076860.5.
Office Action for corresponding Korean patent application No. 10-2019-7016508 (dated Jun. 12, 2020).
International Search Report issued in International Application No. PCT/JP2017/036637, dated Dec. 12, 2017, and English language translation thereof.
Written Opinion issued in International Application No. PCT/JP2017/036637, dated Dec. 12, 2017, and English language translation thereof.
Office Action issued in Chinese Patent Application No. 201780076860.5 dated Sep. 1, 2020 and English Translation thereof.
Office Action issued in corresponding Japanese Patent Application No. 2018-023901 dated Sep. 23, 2020, and English Translation thereof.
Office Action issued in corresponding Japanese Patent Application No. 2018-023901 dated Feb. 9, 2021, and English Translation thereof.

* cited by examiner

METHOD FOR MANUFACTURING METAL BOTTLE, AND METAL BOTTLE

TECHNICAL FIELD

The present invention relates to a method for manufacturing a metal bottle including a screw part and a metal bottle.

BACKGROUND ART

As a metal bottle, a metal bottle having a mouthpiece part, to which a screw-type metal cap is screwed, in an upper part of a bottomed cylindrical bottle body has been spread as a container with a cap for beverage products and the like. In such a metal bottle, the bottle body is subjected to drawing, drawing-ironing, or the like to be formed into a bottomed cylindrical shape, the diameter of an end of the upper part of the bottomed cylindrical-shaped bottle is reduced, so as to form a mouthpiece part, and a screw part is formed on the mouthpiece part by a screw molding device.

The screw molding device used in this case forms a screw part including a crest part and a trough part in the outer circumference of the mouthpiece part with an inner piece that is to be in contact with the inner circumferential surface of the mouthpiece part and an outer piece that is to be in contact with the outer circumferential surface of the mouthpiece part. Such a metal bottle has, at the tip of the mouthpiece part, a curl part, which is formed by folding back the tip thereof to the outer side by a curl molding device.

In such a conventional metal bottle, post machining for forming the curl part and the like is performed after formation of the screw part on the mouthpiece part. Thus, the apex part of the first-stage screw thread close to the curl part is problematically deformed to project further to the outer side than the apex part of other screw threads after post-machining because of an axial direction compression load due to the post machining and smooth opening and closing of the cap become hard, which causes a problem. Some measures for avoiding this problem have been proposed. For example, a conventional technique of PTL 1 described below, the height of the first-stage screw thread (a screw thread close to a curl part) of a screw part is formed lower than the height of screw threads of other stages in a predetermined angle range and, after formation of the curl part at the tip of a mouthpiece part, the height of the first-stage screw thread and the height of the screw threads of the other stages of the screw part are made substantially equal.

CITATION LIST

Patent Literature

[PTL 1] Japanese Patent Application Laid-open No. 2008-87071

SUMMARY OF INVENTION

Technical Problem

According to the conventional technique explained above, the height of the first-stage screw thread is once formed low when the screw part of the metal bottle is formed, and the height of the first-stage screw thread and the height of the screw threads of the other stages of the screw part are then made to be substantially equal by deformation in molding the curl part in the post machining.

After filling content in such a metal bottle, the mouthpiece part of the metal bottle is covered with a metal cap (a cup-shaped cap before screw machining), and the cap is machined into a shape corresponding to the shape of the screw part of the mouthpiece part by a screw machining roll, then the cap is fixed to the screw part and the bottle is sealed.

In this way, the cap is fixed in the shape corresponding to the shape of the screw part of the mouthpiece part of the metal bottle. However, as a container with a cap, it is further desired to improve sealing performance (a retaining force) of the cap by the screw part in the case of a high internal pressure, such as cases during retort sterilization of content or during carbonated beverage filling, easiness of capping machining, operability of recapping, and dropping impact resistance while keeping smoothness in opening and closing the screw-type cap.

The present invention has been proposed to solve such a problem. That is, a problem of the present invention is, for example, to provide a method for manufacturing a metal bottle having a screw part on a mouthpiece part, the method enabling, while keeping smoothness of opening and closing a screw cap, easily manufacturing of a metal bottle in which sealing a cap by the screw part is surely performed even when an internal pressure of the bottle increases, and improvement of easiness of capping machining and operability of recapping, improvement of dropping impact resistance, and the like. Another problem of the present invention is to provide a metal bottle that exerts practically advantageous effects explained above.

Solution to Problem

In order to solve such a problem, the present invention includes the following configuration.

A method for manufacturing a metal bottle having a mouthpiece part in an upper part of a bottomed cylindrical bottle body, the method including the steps of: forming a screw part on the mouthpiece part and, after formation of the screw part, forming a curl part at a tip of the mouthpiece part, wherein, during the formation of the screw part, a height of the first-stage screw thread from a tip side in a complete screw part and a height of the second-stage screw thread from the tip side are substantially equal and a distance between an apex part of the first-stage screw thread and a bottle axis is formed smaller than a distance between an apex part of the second-stage screw thread and the bottle axis and, after the formation of the curl part, a distance between the apex part of the first-stage screw thread and the bottle axis and a distance between the apex part of the second-stage screw thread and the bottle axis are formed substantially equal.

A metal bottle, comprising a mouthpiece part in an upper part of a bottomed cylindrical bottle body; a screw part in the mouthpiece part, and including a curl part at a tip of the mouthpiece part, wherein a height of a first-stage screw thread from a tip side in a complete screw part is larger than a height of a second-stage screw thread from the tip side, and a distance between an apex part of the first-stage screw thread and a bottle axis and a distance between an apex part of the second-stage screw thread and the bottle axis are substantially equal.

Advantageous Effects of Invention

With the method for manufacturing a metal bottle of the present invention, the method enables easily manufacturing of a metal bottle in which sealing a cap by the screw part is surely performed even when an internal pressure of the bottle increases, and improvement of easiness of capping machining and operability of recapping, improvement of dropping impact resistance, and the like while keeping smoothness of opening and closing a screw cap.

With the metal bottle of the present invention, a metal bottle that exerts practically advantageous effects explained above can be provided.

DESCRIPTION OF EMBODIMENTS

Figure 1:
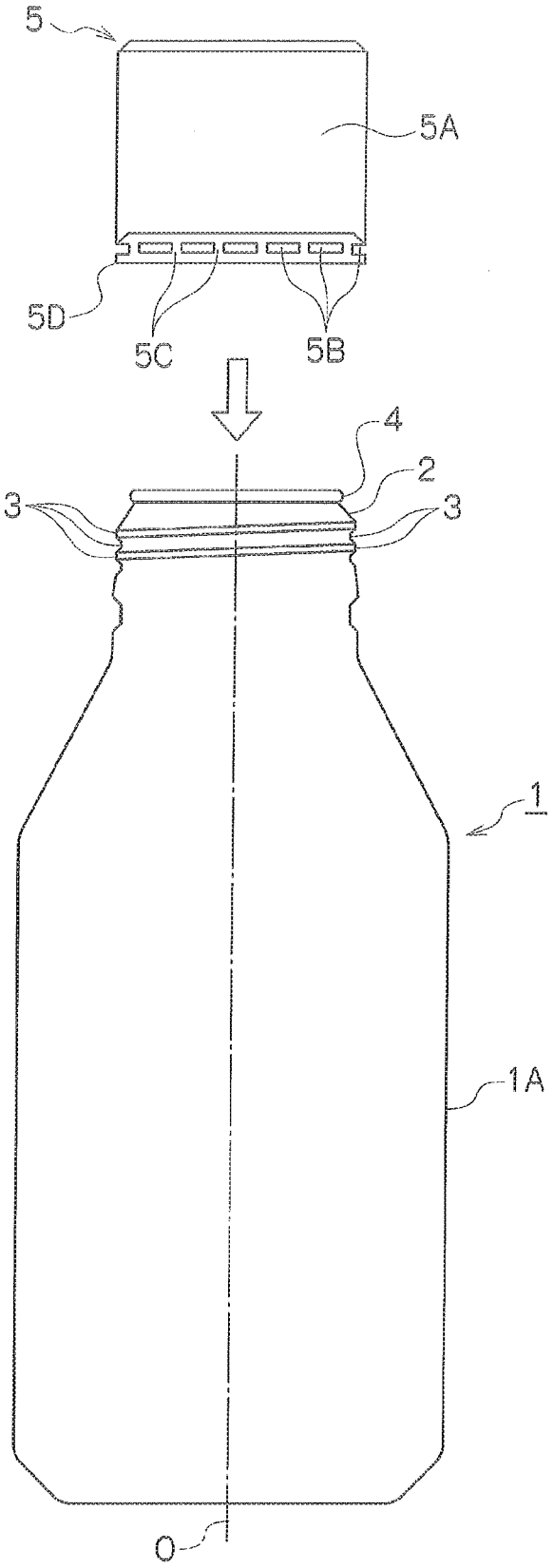
FIG. 1 is an explanatory diagram showing an overall configuration of a metal bottle according to an embodiment of the present invention.

Embodiments of the present invention are explained below with reference to the drawings. In the following explanation, the same reference numerals and signs indicate parts having the same functions even when they are used for designating parts in different figures. Redundant explanation of the parts in the figures is omitted as appropriate.

As shown in FIG. 1, a metal bottle 1 includes a mouthpiece part 2 coaxial with a bottle axis O in an upper part of a bottle body 1A. In the mouthpiece part 2, a screw part 3 is formed. A curl part 4 is formed at the tip of the mouthpiece part 2. For forming the screw part 3 and the curl part 4 in the mouthpiece part 2, as explained above, a screw molding device and a curl molding device are used.

The screw molding device is configured to bring an inner piece into contact with the inner circumferential surface of the mouthpiece part 2 and to bring an outer piece into contact with the outer circumferential surface of the mouthpiece part 2, so as to form the screw part 3 in the outer circumference of the mouthpiece part 2. The curl molding device forms the screw part 3 on the mouthpiece part 2, and thereafter, presses a curl-shaped mold against the tip of the mouthpiece part 2 and fold's back the tip of the mouthpiece part 2 to the outer side, so as to form the curl part 4.

A cap 5 is fixed to the mouthpiece part 2 of the metal bottle 1. The cap 5 includes, for example, in a lower part of a cap body 5A, a score part 5B, a bridge part 5C, and a ring part 5D. The cap 5 is fixed after filling the content in the metal bottle 1. The cap 5 is a metal cap made of a metal plate of aluminum or the like in which screw machining is applied to the cap body 5A by a capping device (not shown) along the screw part 3 provided on the mouthpiece part 2 and the ring part 5D is caulked on a lower side of the screw part 3.

Figure 2:
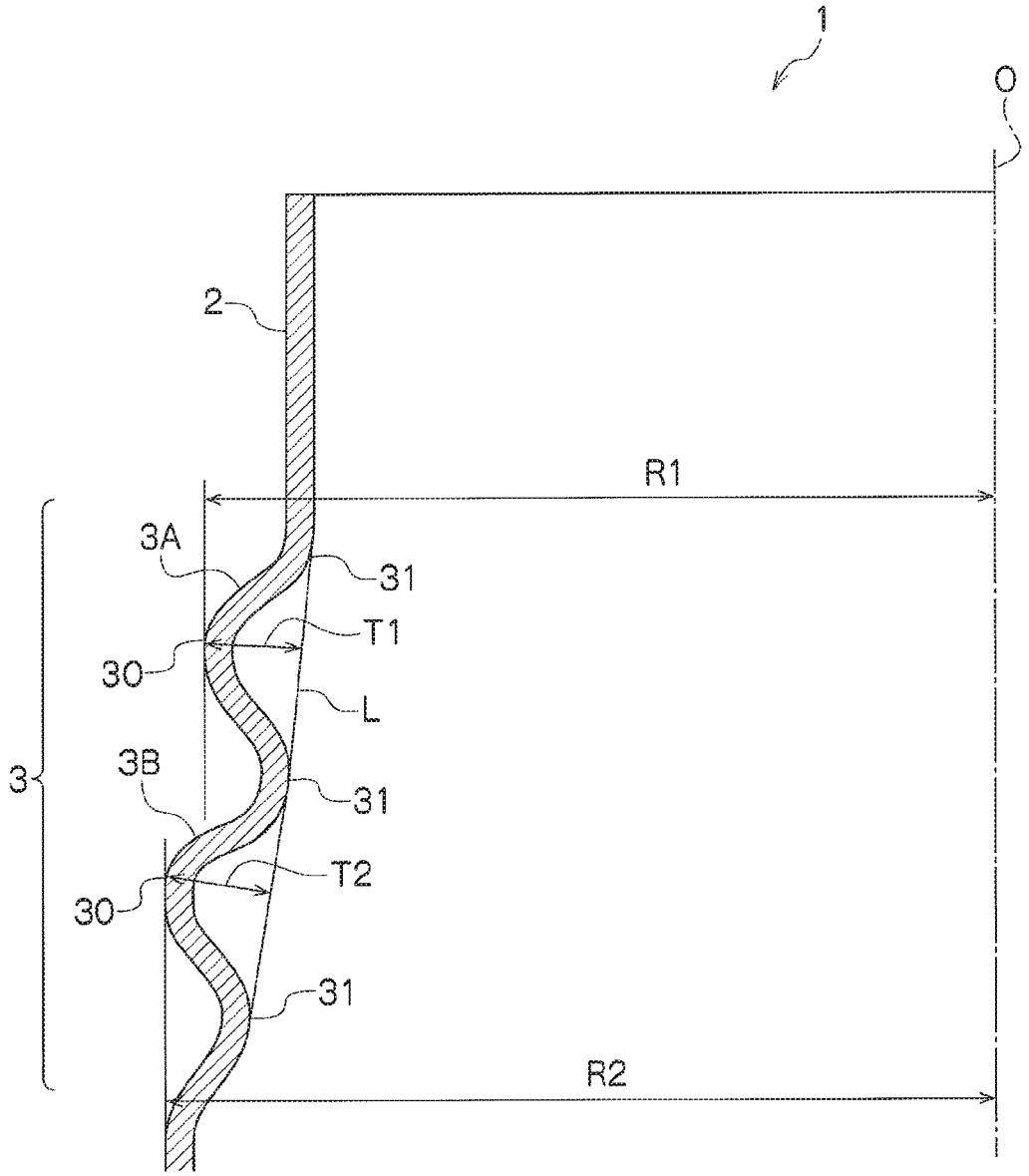
FIG. 2 is an explanatory diagram (a partial sectional view) showing a state in which a screw part is formed in a mouthpiece part of the metal bottle according to the embodiment of the present invention.

FIG. 2 shows a formed state of the screw part 3 on the mouthpiece part 2 of the metal bottle 1. In a cross section shown in the figure of the screw part 3, at least the first-stage screw thread 3A and the second-stage screw thread 3B from the tip side are formed. The first-stage screw thread 3A and the second-stage screw thread 3B each include apex parts 30 projecting toward the outer side and bottom parts 31 projecting toward the inner side.

The mouthpiece part 2 of the metal bottle 1 is formed such that the height T1 of the first-stage screw thread 3A and the height T2 of the second-stage screw thread 3B in the complete screw part of the screw part 3 explained below be substantially equal and the distance R1 between the apex part 30 of the first-stage screw thread 3A and the bottle axis O be smaller than the distance R2 between the apex part 30 of the second-stage screw thread 3B and the bottle axis O (R1<R2).

Now, the "height of a screw thread" is defined as a maximum value of the distance between a line L joining the bottom parts 31 and the apex parts 30 in the screw part 3 (the screw threads 3A and 3B). In the screw part 3, a screw thread gradually increases in height from a screw start point and reaches substantially constant height of the screw thread. A range in which the screw thread gradually increases in height from the screw start point is defined as an incomplete screw part. A range having a substantially constant height of the screw thread is defined as a complete screw part. In FIG. 2, the height of the first-stage screw thread 3A of the screw part 3 is the distance T1 between the apex part 30 and the straight line L and the height of the second-stage screw thread 3B of the screw part 3 is the distance T2 between the apex part 30 and the straight line L. In the embodiment of the present invention, the distance T1 and the distance T2 are formed to be substantially equal (including just equal) (T1≅T2 and T1=T2).

Figure 3:
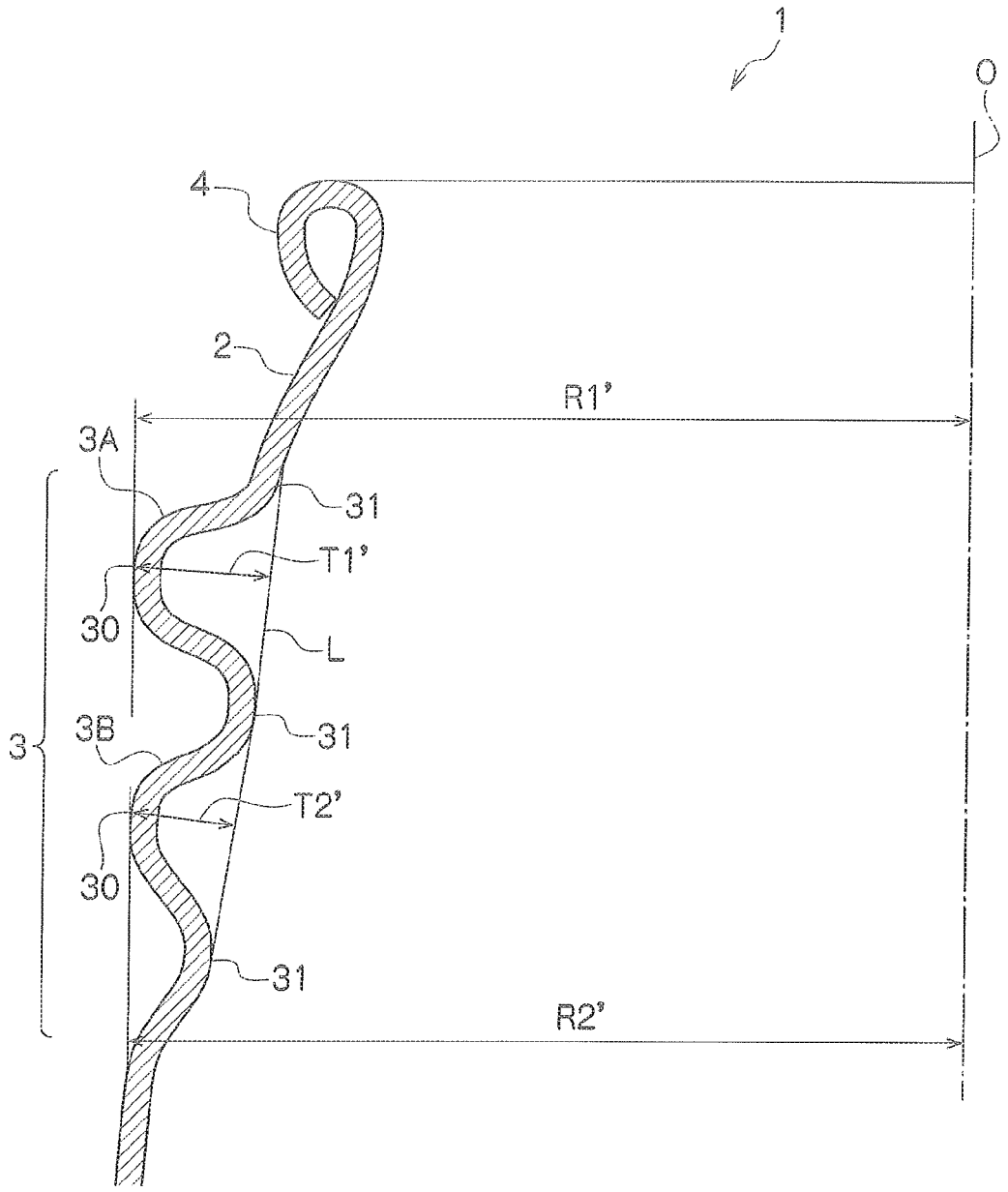
FIG. 3 is an explanatory diagram (a partial sectional view) showing a state where the screw part is formed in the mouthpiece part of the metal bottle, followed by forming a curl part according to the embodiment of the present invention.

FIG. 3 shows a formed state of the curl part 4 in the mouthpiece part 2 of the metal bottle 1. As explained above, the curl part 4 is formed after the formation of the screw part 3. Therefore, after curling-machining of the curl part 4, the screw part 3, in particular, the first-stage screw thread 3A is deformed to project toward the outer side. The screw part 3 are formed, after the formation of the curl part 4, such that the distance R1' between the apex part 30 of the first-stage screw thread 3A of the screw part 3 and the bottle axis O and the distance R2' between the apex part 30 of the second-stage screw thread 3B of the screw part 3 and the bottle axis O be substantially equal (including just equal) (R1'≅R2' and R1'=R2').

According to the embodiment of the present invention with such a configuration, the screw part 3 are formed, in a state after the formation of the screw part 3 and before the formation of the curl part 4, such that the distance R1 between the apex part 30 of the first-stage screw thread 3A of the screw part 3 and the bottle axis O be smaller than the distance R2 between the apex part 30 of the second-stage screw thread 3B of the screw part 3 and the bottle axis O (R1<R2). Therefore, even when the first-stage screw thread 3A of the screw part 3 is deformed so that the diameter of the first-stage screw thread 3A be expanded during the formation of the curl part 4, the apex part 30 of the screw thread 3A is prevented from projecting further to the outer side than the apex part 30 of the screw thread 3B. Consequently, smooth opening and closing of the cap 5 can be achieved.

In the state where the screw part 3 is formed but the curl part 4 is not formed yet, the screw part 3 are formed such that the height (the distance T1) of the first-stage screw thread 3A and the height (the distance T2) of the second-stage screw thread 3B of the screw part 3 be substantially equal (including just equal) (T1≅T2 and T1=T2). Therefore, after the formation of the curl part 4, since the first-stage screw thread 3A is deformed such that the diameter of the first-stage screw thread 3A be expanded, the screw part 3 is formed so that the height (the distance T1') of the first-stage screw thread 3A be larger than the height (the distance T2') of the second-stage screw thread 3B (T1'>T2'). Consequently, in a state in which the cap 5 is fixed, the height (the distance T1') of the first-stage screw thread 3A can be set sufficiently large. Even when a bottle internal pressure is high, sufficiently sealabilty of the cap 5 by the screw part 3 can be secured.

By making the height of the first-stage screw thread 3A of the screw part 3 relatively large, a screw trough can be made deeper. Therefore, during the capping machining, a machining roller of the capping device easily enters the screw trough, so as to facilitate capping machining.

Further, by making the height of the first-stage screw thread 3A of the screw part 3 relatively large, when the cap 5 is recapped, the cap 5 can easily engage with a screw thread, to thereby facilitate smooth recapping.

As shown in FIG. 3, in the metal bottle 1 according to the embodiment of the present invention, the line L joining the bottom parts 31 of the screw part 3 is inclined to the center side with respect to the bottle axis O as the line L goes toward an upper part of the metal bottle 1. Consequently, axial load strength of the entire metal bottle 1 increases and the metal bottle 1 is less easily deformed. Thus, impact resistance upon drop of the screw part 3 formed in the mouthpiece part 2 can be enhanced.

In the embodiment explained above, an example is explained in which the screw part 3 includes the first-stage screw thread 3A and the second-stage screw thread 3B. However, as shown in FIG. 4, the screw part 3 in the present invention may include screw parts (screw threads) in third or higher stages.

Figure 4B:
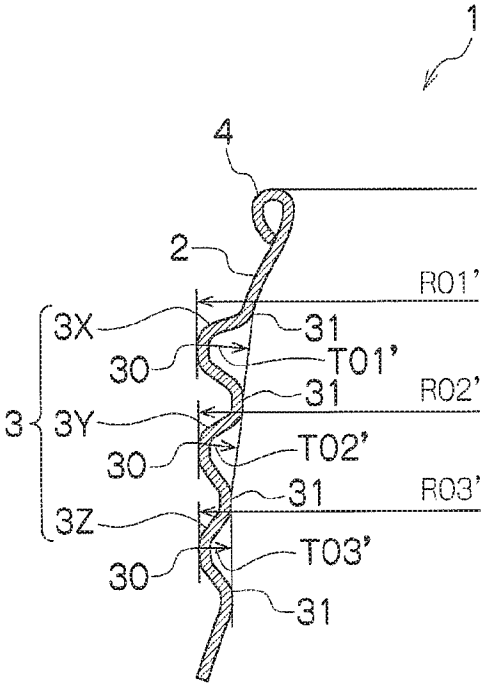
FIG. 4 is an explanatory diagram showing another embodiment of the present invention (FIG. 4 (*a*) shows a state where a screw part is formed on a mouthpiece part but a curl part is not formed yet and FIG. 4 (*b*) shows a state where the screw part is formed on a mouthpiece part, followed by forming a curl part).
Figure 4A:
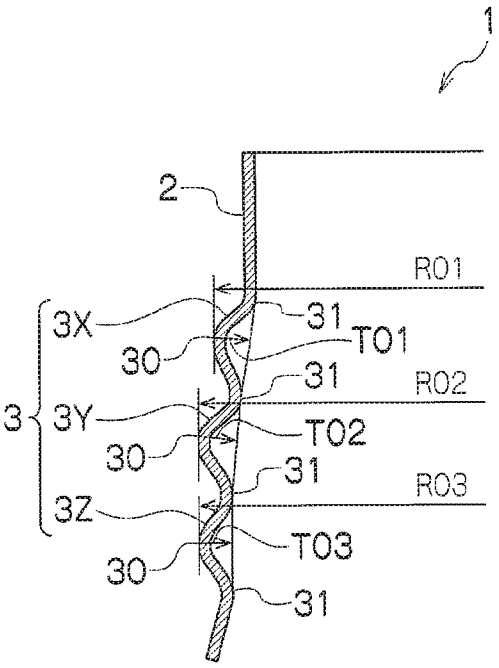

FIG. 4 shows an example in which the screw part 3 includes a first-stage screw thread 3X, a second-stage screw thread 3Y, and a third-stage screw thread 3Z. In this example, before curling machining shown in FIG. 4(*a*), a relation among heights T01, T02, and T03 of the screw threads 3X, 3Y, and 3Z in the three stages satisfies the followings: (T01≅T02≅T03, T01=T02=T03). A relation among distances R01, R02, and R03 between apex parts 30 of the screw threads 3X, 3Y, and 3Z and the bottle axis O satisfies the followings: (R01<R02≅R03, R01<R02=R03).

After curling machining for forming the curl part 4 shown in FIG. 4(*b*), a relation among heights T01', T02', and T03' of the screw threads 3X, 3Y, and 3Z in the three stages satisfies the followings: (T01'>T02'≅T03', T01'>T02'=T03') and a relation among distances R01', R02', and R03' between apex parts 30 of the screw threads 3X, 3Y, and 3Z and the bottle axis O satisfies the followings: (R01'≅R02'≅R03', R01'=R02'=R03').

As explained above, according to the method for manufacturing a metal bottle of the present invention, the method enables easily manufacturing of a metal bottle in which sealing a cap by the screw part is surely performed even when an internal pressure of the bottle increases, and improvement of easiness of capping machining and operability of recapping, improvement of dropping impact resistance, and the like while keeping smoothness of opening and closing a screw cap. It is possible to obtain the metal bottle that assumes the practically advantageous effects explained above.

REFERENCE SIGNS LIST

1 Metal bottle
1A Bottle body
2 Mouthpiece part
3 Screw part
4 Curl part
5 Cap
5A Cap body
5B Score part
5C Bridge part
5D Ring part,
30 Apex part
31 Bottom part

The invention claimed is:

1. A method for manufacturing a metal bottle having a mouthpiece part in an upper part of a bottomed cylindrical bottle body, the method comprising: forming a screw part on the mouthpiece part and, after formation of the screw part, forming a curl part at a tip of the mouthpiece part, wherein, during the formation of the screw part, a height of a first-stage screw thread from a tip side in a complete screw part and a height of a second-stage screw thread from the tip side are substantially equal and a distance between an apex part of the first-stage screw thread and a bottle axis is formed smaller than a distance between an apex part of the second-stage screw thread and the bottle axis and, after the formation of the curl part, a distance between the apex part of the first-stage screw thread and the bottle axis and a distance between the apex part of the second-stage screw thread and the bottle axis are formed substantially equal.

2. The method for manufacturing the metal bottle according to claim 1, wherein, after the formation of the curl part, the height of the first-stage screw thread in the complete screw part is larger than the height of the second-stage screw head.

3. A metal bottle, comprising a mouthpiece part in an upper part of a bottomed cylindrical bottle body; a screw part in the mouthpiece part, and including a curl part at a tip of the mouthpiece part, wherein a segment of the mouthpiece part extends from the curl part and connects with the screw part, wherein a height of a first-stage screw thread from a tip side in a complete screw part is larger than a height of a second-stage screw thread from the tip side, and a distance between an apex part of the first-stage screw thread and a bottle axis and a distance between an apex part of the second-stage screw thread and the bottle axis are substantially equal, and a portion of the segment of the mouthpiece part forms a bottom part of the first-stage screw, wherein the bottom part is angularly offset from a sidewall of the first-stage screw closer to the tip.

* * * * *